US007382088B2

(12) United States Patent
Azuma et al.

(10) Patent No.: US 7,382,088 B2
(45) Date of Patent: Jun. 3, 2008

(54) ELECTRON SOURCE AND IMAGE DISPLAY APPARATUS

(75) Inventors: Hisanobu Azuma, Hadano (JP); Jun Iba, Yokohama (JP); Yasuo Ohashi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 11/464,098

(22) Filed: Aug. 11, 2006

(65) Prior Publication Data

US 2007/0046173 A1 Mar. 1, 2007

(30) Foreign Application Priority Data

Aug. 24, 2005 (JP) ..... 2005-241944
Aug. 8, 2006 (JP) ..... 2006-215176

(51) Int. Cl.
*H01J 19/00* (2006.01)

(52) U.S. Cl. ..... 313/495; 313/331

(58) Field of Classification Search ..... None
See application file for complete search history.

(56) References Cited

U.S. PATENT DOCUMENTS

| | | | | |
|---|---|---|---|---|
| 5,594,298 | A | 1/1997 | Itoh et al. | 313/336 |
| 5,633,560 | A * | 5/1997 | Huang | 313/495 |
| 6,246,168 | B1 * | 6/2001 | Kishi et al. | 313/495 |
| 6,313,815 | B1 * | 11/2001 | Takeda et al. | 345/75.2 |
| 6,703,791 | B2 | 3/2004 | Azuma | 315/169.3 |
| 6,972,203 | B2 | 12/2005 | Azuma | 438/20 |
| 7,151,005 | B2 | 12/2006 | Azuma | 438/20 |
| 2002/0195924 | A1 * | 12/2002 | Raina | 313/495 |
| 2005/0040752 | A1 * | 2/2005 | Lee et al | 313/495 |
| 2006/0063459 | A1 | 3/2006 | Iba et al. | 445/3 |
| 2006/0087219 | A1 | 4/2006 | Taniguchi et al. | 313/495 |
| 2006/0087220 | A1 | 4/2006 | Hiroki et al. | 313/495 |
| 2006/0091780 | A1 * | 5/2006 | Minami | 313/495 |
| 2006/0164001 | A1 | 7/2006 | Iba et al. | 313/495 |
| 2007/0020787 | A1 | 1/2007 | Azuma | 438/20 |

FOREIGN PATENT DOCUMENTS

| | | |
|---|---|---|
| JP | 7-94076 | 4/1995 |
| JP | 9-245689 | 9/1997 |
| JP | 9-298030 | 11/1997 |

OTHER PUBLICATIONS

*Handbook of Vacuum Arc Science and Technology*, Noyes Publications, 1995; pp. 80-89.

* cited by examiner

*Primary Examiner*—Ashok Patel
(74) *Attorney, Agent, or Firm*—Fitzpatrick, Cella, Harper & Scinto

(57) ABSTRACT

To implement an electrode structure which brings about extinction of arc quickly in a reliable manner without maintaining discharge current, and provide an electron source and image display apparatus equipped with the electrode structure.

Device electrodes 2 and 3 are partially narrowed in areas where they are connected to scan wiring 6 and signal wiring 4, and an insulating layer 5 which insulates the scan wiring 6 and signal wiring 4 are extended to cover the narrow portions of the device electrodes 2 and 3.

8 Claims, 8 Drawing Sheets

ELECTRON SOURCE AND IMAGE DISPLAY APPARATUS

BACKGROUND OF THE INVENTION

1. Field of the Invention

The present invention relates to an electron source with an electrode structure which reduces discharges as well as to an image display apparatus which uses the electron source.

2. Description of the Related Art

Conventional uses of electron-emitting devices include image display apparatus. For example, an evacuated flat electron beam display panel in which an electron source substrate and counter substrate are placed opposite each other in parallel is known, where the electron source substrate contains a large number of cold-cathode electron-emitting devices and the counter substrate is equipped with an anode electrode which accelerates electrons emitted from the electron-emitting devices and phosphor which acts as a light emitting member. The flat electron beam display panel can have lighter weight and larger screen size than cathode ray tube (CRT) display apparatus widely used today. Also, it can provide brighter, higher-quality images than other flat display panels such as flat liquid crystal display panels, plasma displays, and electroluminescent displays.

Thus, for image display apparatus which apply voltage between the anode electrode and cold-cathode electron-emitting devices to accelerate the electrons emitted from the cold-cathode electron-emitting devices, it is advantageous to apply a high voltage to maximize emission brightness. Emitted electron beams are dispersed before reaching the anode electrode depending on the type of device, and thus, to implement a high-resolution display, it is preferable to reduce inter-substrate distance between rear plate and face plate.

However, a shorter inter-substrate distance essentially results in a higher electric field between the substrates, making the electron-emitting devices more susceptible to breakage due to discharges. Japanese Patent Application Laid-Open No. H09-298030 discloses an image display apparatus which places an overcurrent protective member of a low melting-point material between a conductive film equipped with an electron-emitting area and device electrodes and thereby prevents impacts on other devices in case of a short circuit between device electrodes. Japanese Patent Application Laid-Open No. H09-245689 discloses an image display apparatus which places a fuse outside an active area. Japanese Patent Application Laid-Open No. H07-94076 discloses an idea of installing a resistive layer which is burnt out by a short-circuit current, to provide against an emitter-gate short circuit in an FED. It also discloses that by covering the resistive layer with an insulating layer, it is possible to prevent gas generation in case the resistive layer melts, and thereby prevent secondary discharges caused by gas.

However, the techniques disclosed in Japanese Patent Application Laid-Open No. H09-298030, Japanese Patent Application Laid-Open No. H09-245689 and Japanese Patent Application Laid-Open No. H07-94076 are not sufficient and there has been a demand for a method which can prevent the impact of discharges more reliably. If voltage applied to an image forming member is set at a high level, fuses burnt out by discharges can sometimes cause new discharges to be generated, resulting in discharging of large current for an extended period of time. This increases damage and fatally contaminates a vacuum atmosphere in the panel, posing a serious problem to device reliability.

SUMMARY OF THE INVENTION

The present invention has an object to solve the above problems, implement an electrode structure which brings about extinction of arc quickly in a reliable manner without maintaining discharge current, and provide an electron source and image display apparatus equipped with the electrode structure.

According to a first aspect of the present invention, there is provided an electron source comprising:

a plurality of electron-emitting devices each of which has a pair of device electrodes, and an electron emitting area between the pair of device electrodes;

first wiring which connects one of the pair of device electrodes of the plurality of electron-emitting devices;

second wiring which connects the other of the pair of device electrodes of the plurality of electron-emitting devices and intersects the first wiring; and an insulating layer which insulates at least an intersection of the first wiring and second wiring and partially covers at least one of the pair of device electrodes, wherein the one of the pair of device electrodes has a first area and a second area located between the first area and the first wiring and more fusible than the first area, and the second area is covered partially with the insulating layer.

According to a second aspect of the present invention, there is provided an image display apparatus comprising the electron source according to the first aspect of the present invention; and an image forming member which has at least a light emitting member for emitting light by irradiation with electrons emitted from the electron source and electrodes used to apply voltage to accelerate the electrons.

Further features of the present invention will become apparent from the following description of exemplary embodiments (with reference to the attached drawings).

DESCRIPTION OF THE EMBODIMENTS

Figure 1:
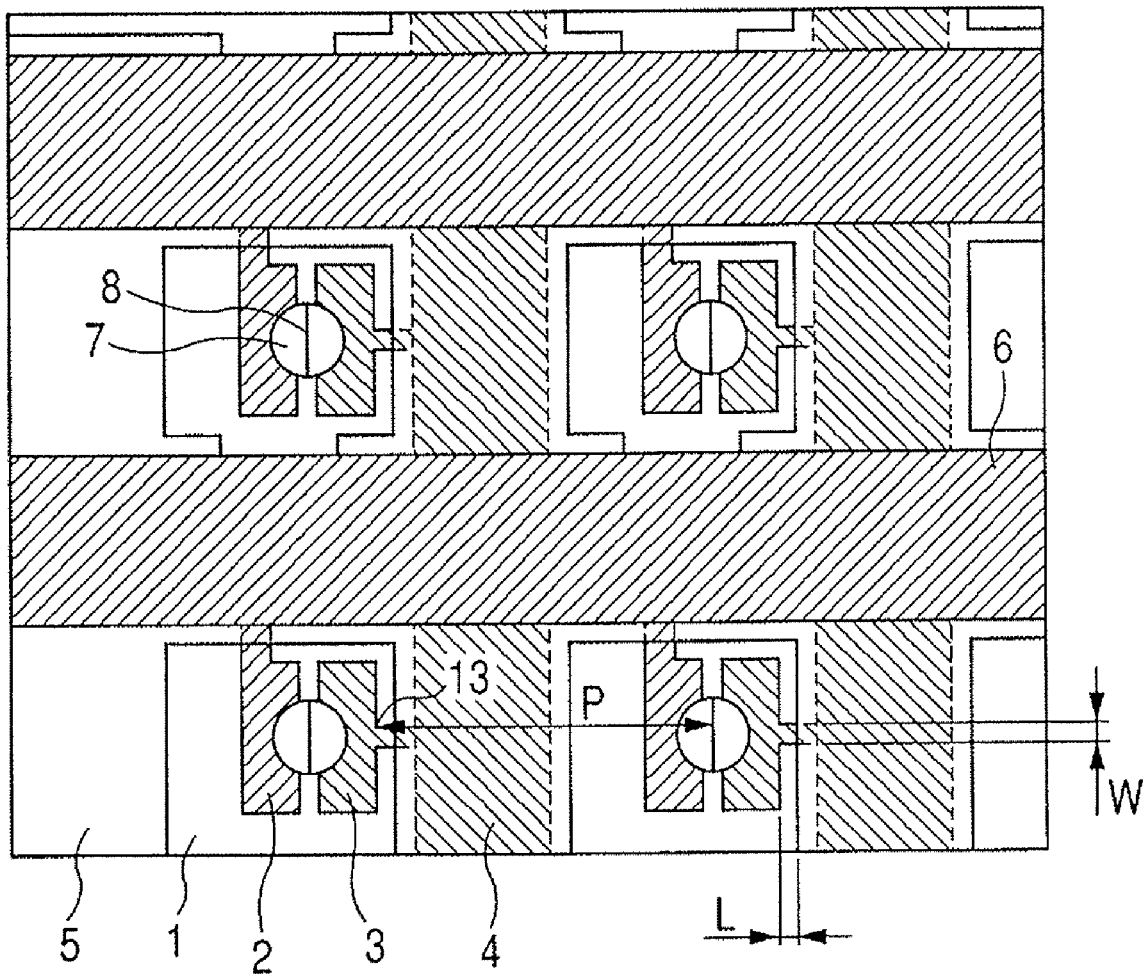
FIG. 1 is a schematic plan view of a first embodiment of an electron source according to the present invention.

A preferred embodiment of the present invention will be described with reference to FIG. 1. FIG. 1 shows a preferred form of an electron source according to the present invention, where reference numeral 1 denotes a glass substrate (PD200 manufactured by Asahi Glass Co., Ltd.: soda lime glass, quartz, etc.) or an electron source substrate consisting of a ceramic substrate. The electron source substrate 1 is sometimes coated with silica serving as an alkali block layer to prevent impact on electron source characteristics. Reference numerals 2 and 3 respectively denote a scan-side device electrode and signal-side device electrode made of metal film such as Pt, Au, or Ru. Reference numeral 7 denotes a conductive film including an electron emitting area 8. The conductive film 7 is made of a metal such as Pd or Ru or its oxide.

The signal-side device electrode 3 is electrically connected with signal wiring 4 which transmits a display signal waveform from an external driver (not shown) to the device. The scan-side device electrode 2 is electrically connected with scan wiring 6 which transmits a scan signal waveform from an external driver (not shown) to the device. The signal wiring 4 and scan wiring 6, which should have low resistance from the viewpoint of display quality and power consumption, are produced by thick-film printing (screen printing or offset printing), photo printing using photosensitive printing paste, gold-plating or the like. Preferable wiring materials include Ag and Cu.

An electrically insulating layer or high-resistance layer should be provided between the signal wiring 4 and scan wiring 6. An insulating layer 5 is provided in FIG. 1. The insulating layer 5 can be produced mainly from PbO using thick-film printing or printing by means of photo paste.

A fabrication process of the electron source in FIG. 1 is shown in FIGS. 2A to 2F.

Figure 2A:
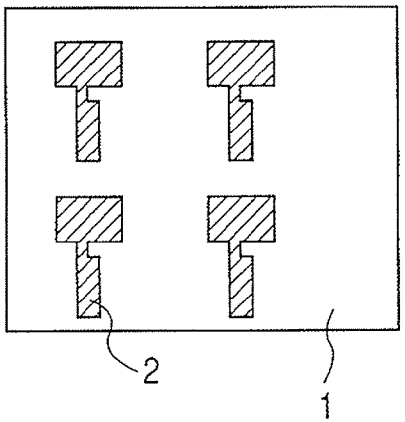
FIGS. 2A, 2B, 2C, 2D, 2E and 2F are schematic plan views showing a fabrication process of the electron source shown in FIG. 1.
Figure 2B:
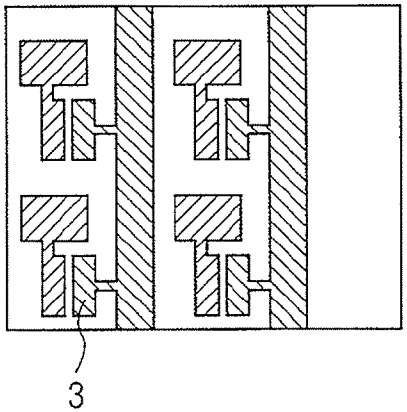
Figure 2C:
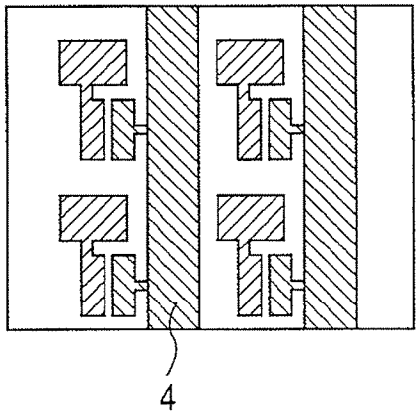
Figure 2D:
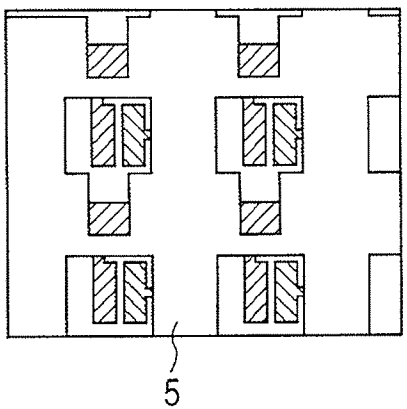
Figure 2E:
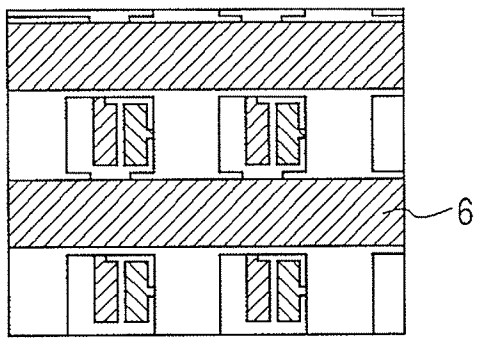
Figure 2F:
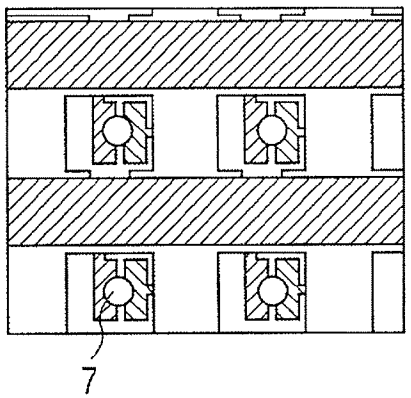

The scan-side device electrode 2 is created on the electron source substrate 1 by a thin-film process (FIG. 2A) and the signal-side device electrode 3 is created in a similar manner (FIG. 2B). The scan-side device electrode 2 and signal-side device electrode 3 are formed by spattering, vacuum deposition, plasma CVD or other process. Next, as shown in FIG. 2C, the signal wiring 4 is created by a thick-film printing process such as screen printing, or photo paste printing by the use of photosensitive material. The material used is Ag mixed with glass content. Next, a pattern of the insulating layer 5 is formed by photo paste printing (FIG. 2D). The insulating layer 5, which requires patterning accuracy, is created by application, exposure, drying, developing and baking from photo paste prepared by mixing a photosensitive material and glass content. Subsequently, the scan wiring 6 is created by a thick-film printing process (FIG. 2E) and the conductive film 7 is formed of Pd and the like by inkjet coating (FIG. 2F).

Next, an electromachining process called energization forming is performed. The energization forming involves passing a current between the device electrodes 2 and 3 from a power supply (not shown) via the scan wiring 6 and signal wiring 4, locally destroying or deforming the conductive film 7 or changing its quality, and thereby forming an area whose structure has been changed. The area whose structure has been changed locally is called an electron emitting area 8.

Preferably the device which has undergone energization forming is subjected to a process called an activation process. The activation process is the process of introducing an activating gas so as to create a vacuum, for example, on the order of $10^{-2}$ to $10^{-3}$ Pa and applying voltage pulses of a constant peak value repeatedly as is the case of energization forming. This causes carbon and carbon compounds originating from organic substances present in the vacuum to deposit on a conductive thin film, thereby changing a device current If and emission current Ie greatly. The activation process is performed by measuring the device current If and emission current Ie and finished when, for example, the emission current Ie is saturated. The voltage pulses applied are desirably at a drive voltage. This enables electron emission through nanogaps, and the electron source is completed.

The electron source is joined hermetically with a face plate on which a light emitting member such as a phosphor and aluminum metal back is placed as well as with a supporting frame and the like, and the inside is evacuated to produce an image display apparatus.

An advantage of the present invention will be described concretely with reference to FIGS. 3A to 3E.

Figure 3A:
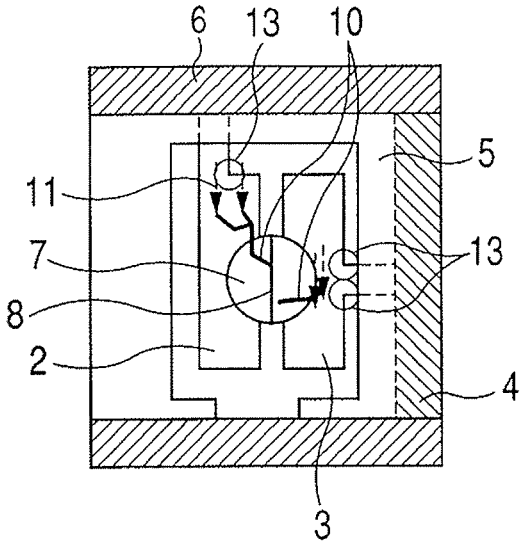
FIGS. 3A, 3B, 3C, 3D and 3E are diagrams illustrating an advantage of the present invention in detail.

Vacuum discharges can occur in an image display apparatus because a high voltage on the order of kV to tens of kV is applied to a light emitting member (anode) which emits light in response to electron beams emitted from electron-emitting devices. Although the cause of the discharges remains to be explained definitely, current flow produced by the discharges can often damage the electron-emitting devices as shown in FIG. 3A. Discharge damage leaves traces of cathode spots 10 on the conductive film 7 and device electrodes 2 and 3. Electrode material allegedly melts and evaporates at the cathode spots 10, and a current 11 flows from the anode (not shown) into the cathode spots 10.

Figure 3B:
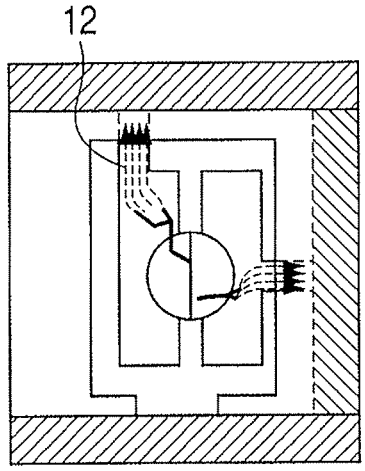
Figure 3C:
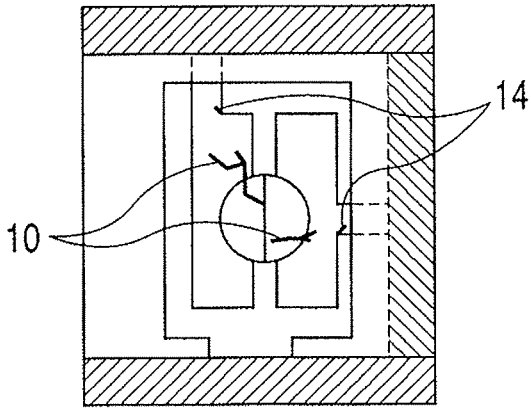

FIG. 3B schematically shows current 12 on device electrodes 2 and 3. As shown in FIG. 3B, current concentration, generation of Joule heat, and melting of device electrodes occur at the tips of the cathode spots 10, and consequently the cathode spots advance upstream (to the low-potential side) where electric charges are supplied. The current 12 flows from the anode to the device electrodes 2 and 3 through the vacuum and cathode spots 10. Joule heat is generated due to current concentration and material begins to melt in suddenly changing portions 13 (those parts at the ends of fusible second areas which are most prone to becoming hot) on the device electrodes 2 and 3. Then, new cathode spots 14 are initiated in the suddenly changing portions 13 on the device electrodes 2 and 3 as shown in FIG. 3C. A suddenly changing portion is a part where a cross sectional area or resistance for current flow literally changes suddenly.

Figure 3D:
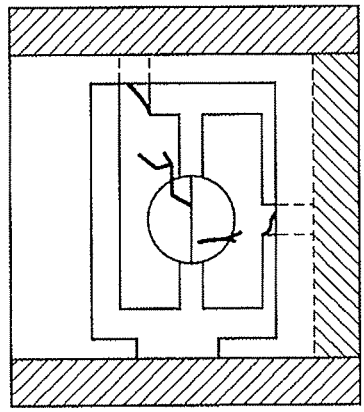

Impedance increases and discharges begin to converge (extinction of arc) at the old cathode spots 10 due to the cathode spots 14 initiated upstream. On the other hand, the cathode spots 14 initiated in the suddenly changing portions 13 are located near the insulating layer 5, and consequently they are shielded by the insulating layer 5 and extinguished upon reaching the insulating layer 5 (FIG. 3D). The insulating layer 5 which functions as the shielding member has a sufficiently high resistance or consists of an insulating material. Also, the higher the thermal capacity (specific heat×density) and melting point, the better.

Thus, the advantage of the present invention is obtained by providing parts more fusible (second areas) than other parts and exposing them partially, from the insulating layer 5, to connections with wiring. In the configuration in FIG. 3, the narrow parts of the device electrodes extending from the suddenly changing portions 13 to connections with wiring are second areas, and the other parts of the device electrodes are first areas. In this structure, the fusible second areas reach a high temperature above their melting point when a threshold current flows, shifting the cathode spots to the exposed areas of the second areas. This makes it possible to quench discharges quickly. Preferably the threshold current is set to discharge current as described above. Incidentally, in the case of an image display apparatus, the discharge current depends on the area of the anode, applied voltage, distance between the anode and electron source, anode impedance (described later) etc. For example, if the anode area is 0.4 $m^2$, the applied voltage is 10 kV, and the distance between the anode and electron source is 1.6 mm; then the discharge current is somewhere around 100 amp. depending on the impedance. Also, to reduce the discharge current, the anode is sometimes divided with the resistance among the divisions increased sufficiently. In that case, the discharge current is reduced to the order of 100/N amp. according to the number N of divisions of the anode. Also, desirably the threshold current is set, for example, to a value equal to or lower than allowable current of a driver. Then, even if a single bit fails when a device electrode is broken by a discharge, the driver will remain intact and damage will not spread to a line or block. More preferably, the threshold current is determined by taking into consideration the resistance of the higher resistance wiring, which is assumed here to be a signal wire. When a discharge current flows through the signal wire, a potential rises, causing damage to the electron-emitting devices connected to the signal wire. To avoid this situation, the threshold current is set to Vth/Rsig or below, where Vth is a threshold voltage at which the device is damaged and Rsig is the resistance of the signal wiring to ground. Incidentally, the threshold voltage at which the device is damaged is a maximum voltage applied to devices during manufacturing in the case of surface-conduction electron emitters (described later). Specifically, it is a maximum applied voltage in forming, activation or other process (described later). Next, structures of fusible areas (hereinafter sometimes referred to as hot portions) will be described concretely in detail.

(Suddenly Changing Structure and Thin Line Structure)

Figure 3E:
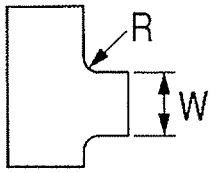

Temperature rises in the suddenly changing portions 13 can be determined from electrical properties (resistance and temperature resistance coefficient) and thermal properties (thermal conductivity, density and specific heat) of wiring material (the device electrodes 2 and 3), thermal properties of the substrate, and geometries of the wiring material and substrate. For example, a coupled current-field and thermal-conductivity analysis conducted by a finite element solver using shapes and currents as inputs makes it possible to predict that the cathode spots move from 10 to 14 when the temperature reaches the melting point. The new cathode spots 14 are extinguished quickly by shielding effect of the insulating layer 5, making it possible to predict and control the discharge current and its duration. To take full advantage of the current-concentrating effect of the suddenly changing portions 13, it is preferable to provide narrow portions with a width of W as fusible hot portions behind the suddenly changing portions 13 (near the insulating layer 5) and set a curvature radius R of the suddenly changing portions to R<(W/5) to (W/10). FIG. 3E shows an enlarged view of an area near a suddenly changing portion 13 shown in FIG. 3D.

Figure 4A:
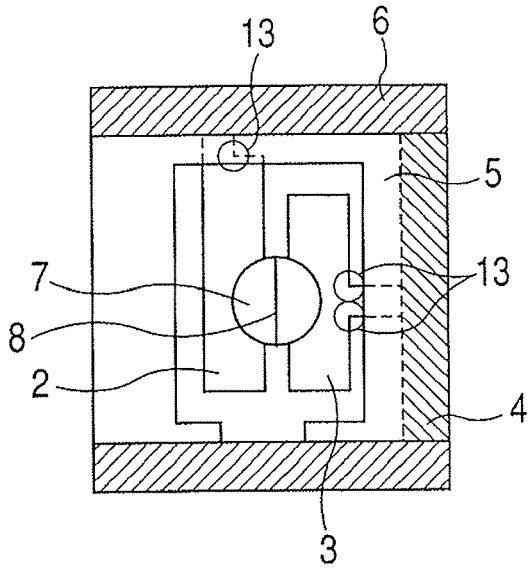
FIGS. 4A, 4B, 4C and 4D are schematic diagrams showing a concrete example of high temperature areas according to the present invention.

When there are two or more suddenly changing portions 13—as shown in FIG. 4A—which become hot and melt when a current above a threshold flows, a configuration may be adopted in which some of them are covered completely with the insulating layer 5 which is a shielding layer. Also, when there are two or more fusible areas, a configuration may be adopted in which some of them are covered completely with the insulating layer. That is, according to the present invention, it is sufficient if only part of the fusible areas is exposed from the insulating layer. Again, in the configuration in FIG. 4A, the fusible second areas (hot portions) are provided as narrow portions with a width of W behind the suddenly changing portions 13 (near the insulating layer 5).

Figure 4B:
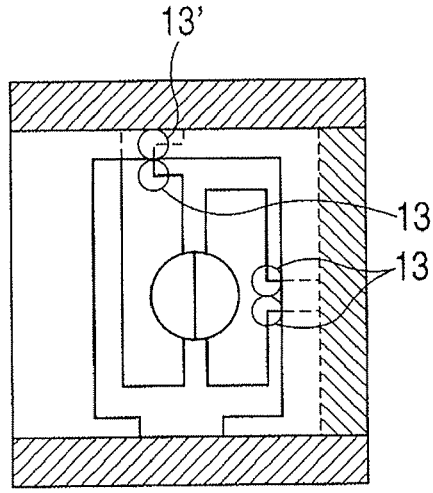
Figure 4C:
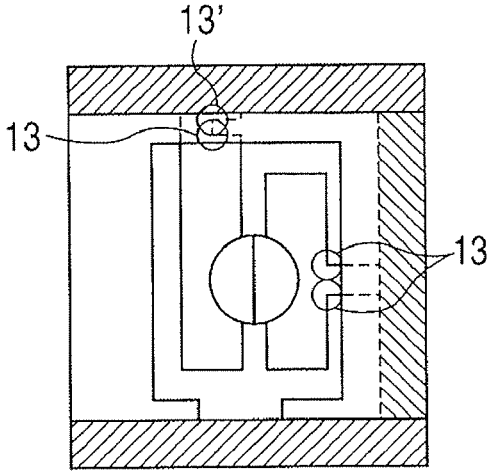

FIG. 4B shows a structure in which, two suddenly changing portions 13 and 13' are created to initiate a cathode spot 14 more reliably and extinguish an old cathode spot reliably. Incidentally, in FIGS. 4B, 4C and 4D, reference numerals of the same components as those in FIG. 4A are omitted. In FIG. 4B, a fusible second area (hot portion) is provided by forming a narrow portion in part of the device electrode 2. Also, as shown in FIG. 4C all the two suddenly changing portions 13 and 13' may be covered with the insulating layer 5 which is a shielding layer.

Although various forms of only the device electrode 2 have been shown above in FIGS. 4A to 4C, exactly the same configurations can be used for the device electrode 3 without any problem.

(High-Resistance Structure)

Figure 4D:
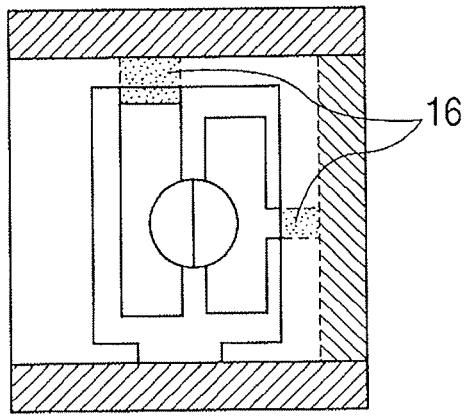
Figure 5A:
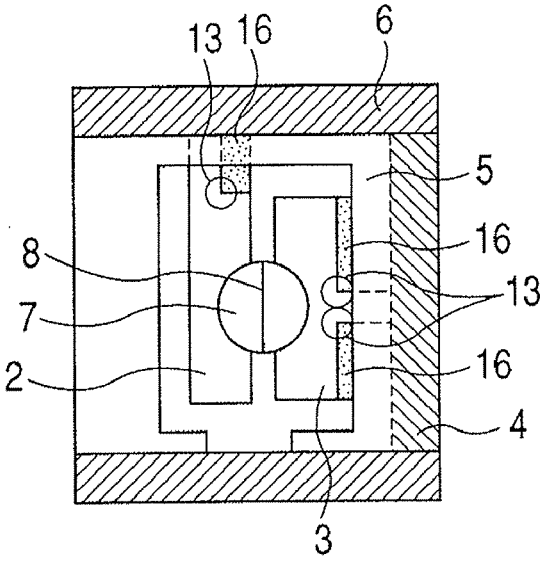
FIGS. 5A, 5B, 5C and 5D are schematic diagrams showing a concrete example of the high temperature areas according to the present invention.
Figure 5B:
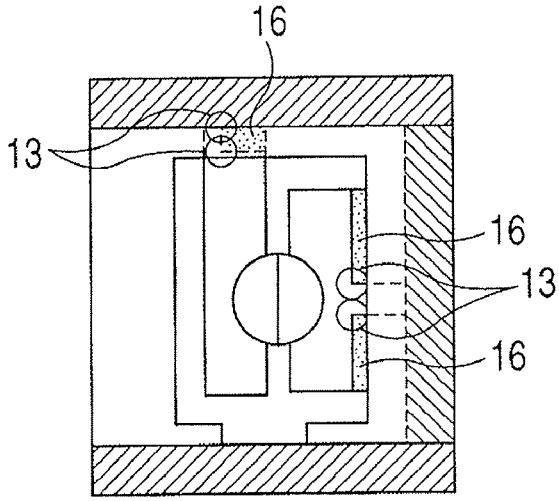
Figure 5C:
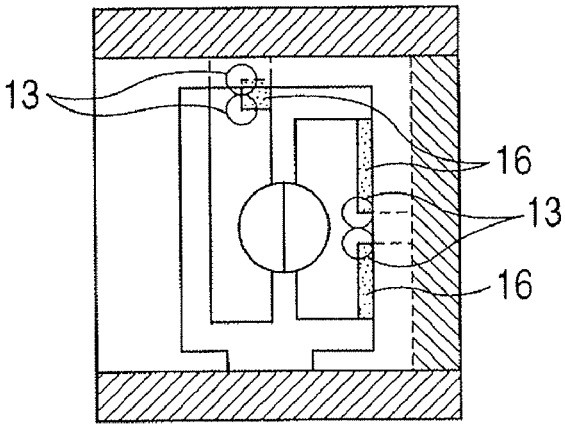
Figure 5D:
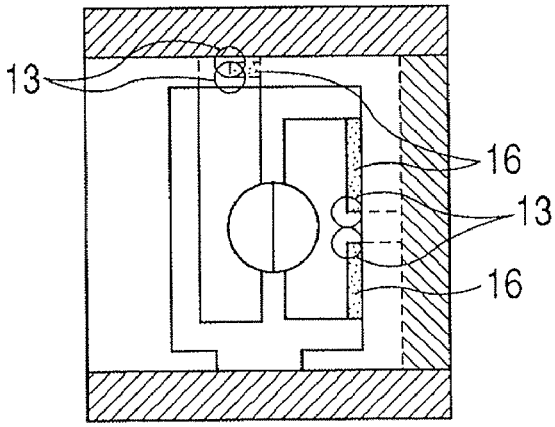

In FIG. 4D, instead of providing a narrow portion, a high-resistance portion 16 is formed as a fusible hot portion (second area) just below or near the insulating layer 5 on the device electrode 2. Possible means of partially increasing resistance include reducing the film thickness partially or making the film porous or coarse. On the other hand, the configuration according to the present invention can be achieved easily if a high-resistance material different from the material for the other part is used for the high-resistance portion 16. Incidentally, the device electrode 3 in FIG. 4D has a high-resistance portion and narrow portion, and both of them form fusible second areas. Also, in FIGS. 4C and 4D, some of the multiple suddenly changing portions or high-resistance portions are covered with the insulating layer 5, and it is sufficient if only part of them is exposed from the insulating layer as in the case of FIG. 4A.

Instead of replacing all the areas containing suddenly changing portions with high-resistance portions 16 as shown in FIG. 4D, only part of areas containing suddenly changing portions may be replaced with high-resistance portions 16 as shown in FIGS. 5A to 5D. Such a structure causes current to flow by avoiding the high-resistance portions 16, and thus current concentration occurs in suddenly changing portions 13, making them hotter than their surroundings. In other words, by inserting high-resistance portions among low-resistance portions, it is possible to provide portions on which current is concentrated and make these portions hotter. Thus, in the configuration in FIGS. 5A to 5D, fusible second areas (hot portions) are provided as narrow portions adjacent to the high-resistance portions 16.

(Configuration)

It is also possible to provide hot portions by varying thermal conductivity, heat diffusion coefficient, specific heat and density instead of electrical characteristics from the surroundings. Specifically, hot portions can be provided by lowering the thermal conductivity of the high-resistance portions 16 in FIG. 4D and FIGS. 5A to 5D, which in turn can be achieved by decreasing the heat diffusion coefficient, specific heat and density.

If materials are selected such that the melting point of the high-resistance portions 16 will be lower than the melting point of the insulating layer 5, it is possible to ensure that extinction of arc will be achieved reliably. This is because if the melting point of the high-resistance portions 16 is higher than that of the insulating layer 5, the insulating layer 5 is likely to melt when the high-resistance portions 16 melts. In that case, the shielding effect of the insulating layer 5 for the cathode spots 14 will be reduced. Preferably, difference in the melting point between the high-resistance portions 16 and insulating layer 5 is 500° C. or more.

To maintain the shielding effect even when the insulating layer 5 melts, the insulating layer must have a sufficient thickness. That is, the use of a material with a high melting point makes it possible to reduce the thickness of the insulating layer 5. Preferably, the insulating layer 5 is made of a material with a high melting point such as $SiO_2$, alumina ($Al_2O_3$) or zirconia ($ZrO_2$).

Preferably, the high-resistance portions 16 are made of a material with a low melting point such as lead, zinc, aluminum or ITO containing In.

(Rules for Creepage Distance)

Figure 6A:
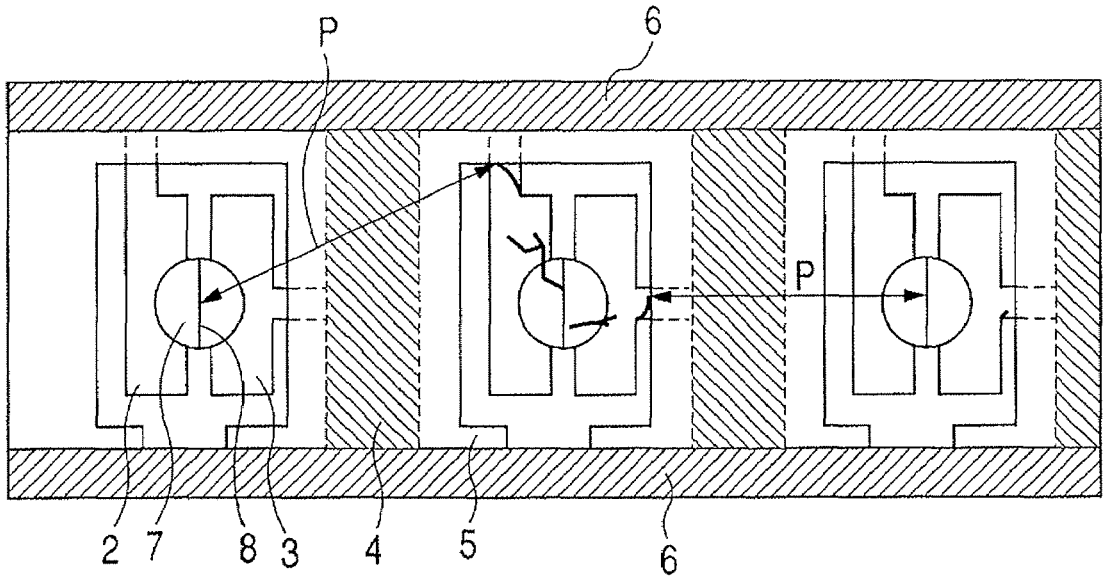
FIGS. 6A and 6B are schematic diagrams showing a preferred configuration example of the high temperature areas according to the present invention.

Preferable locations of exposed areas of the high-resistance portions 16 or suddenly changing portions 13 in FIGS. 3 to 5 with respect to the insulating layer 5 will be described with reference to FIG. 6. Incidentally, FIG. 6B is an enlarged view of that part of the device electrode 2 of the device in the center of FIG. 6A which is located near the region covered with the insulating layer 5.

Figure 6B:
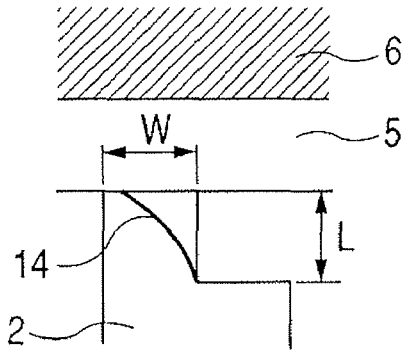

As shown in FIG. 6B, when a current is passed through the wiring, the cathode spot 14 advances from the suddenly changing portion 13—which becomes the hottest except for the electron emitting area 8—to the insulating layer 5, and then stagnates at the side of the insulating layer 5 due to electrical shielding effect. Let L denote the distance from the suddenly changing portion 13 to the insulating layer 5 and let W denote the width (covering width of device electrode with the insulating layer) of an exposed area of a hot portion (fusible second area) at a boundary between the exposed area and insulating layer. It can be seen that until extinction, the cathode spot 14 advances to a distance of (W+L) at the most from the suddenly changing portion 13 which becomes the hottest. If the time until extinction is $\tau$ and the rate of advance of the cathode spot 14 is $V_{arc}$ (=200 m/s), then it can be estimated that $\tau=(W+L)/V_{arc}$.

On the other hand, gas generated from the cathode spot 14 diffuses to surrounding areas at a velocity $V_{gas}$ given by the equation below and reaches an adjacent electron-emitting device. If gas partial pressure rises there, the adjacent electron-emitting device may discharge.

$$V_{gas}=(2RT/M)^{1/2}$$

[where,

R: gas constant=8.314772 J/molK

T: melting point of the electrode (Pt, according to the present invention)=2042.15K M: mass numbers of spouting gases (Ar and Pt, according to the present invention; 39.948 g/mol which is the mass number of Ar is adopted)]

In this case, the given electron-emitting device and the adjacent electron-emitting device are damaged in succession, resulting in marked defects. To avoid this situation, a necessary condition is that arrival time ($P/V_{gas}$) determined by the distance P from the cathode spot 14 to the electron emitting area 8 of the adjacent electron-emitting device and the velocity $V_{gas}$ of gas molecules is larger than the time $\tau$ until extinction. Incidentally, the location of the cathode spot 14, which moves to the suddenly changing portion 13, can be substituted with the location of the suddenly changing portion 13.

It is an important condition that the time $\tau$ until extinction is shorter than a time period 1H of selecting scan wiring. 1H is defined as follow:

$$1H=(f\times N)^{-1}[\text{sec}].$$

Wherein, f is a scroll frequency (Hz), and N is a scanning frequency (Hz).

In general, a gas reaching time is shorter than 1H. Accordingly, the above condition would be met if the time $\tau$ until extinction is shorter than the gas reaching time.

That is, $P/V_{gas}\geqq(W+L)/V_{arc}$, meaning that the distance L from the hot portion to the insulating layer 5 and the electrode width W must satisfy the condition $W+L\leqq P\cdot V_{arc}/V_{gas}$.

Generally, the velocity $V_{arc}$ of a cathode spot is reported to range from 10 to 500 m/s (HANDBOOK OF VACUUM ARC SCIENCE AND TECHNOLOGY, NOYES PUBLICATIONS, 1995, pp 86). According to the present invention, approximately $V_{arc}$=200 m/s. The gas velocity $V_{gas}$ is $(2RT/M)^{1/2}$ where R is a gas constant (8.314772 J/molK). According to the present invention, platinum electrode material and gases such as Ar taken in during deposition of the platinum electrode material are predominant, and thus T is between the melting point and boiling point of platinum (2,042 to 4,100 K) and M=39.95. It follows that the gas velocity $V_{gas}$ is approximately 1000 m/s. Therefore, the distance $(W+L)\leqq P/5$. More particularly, for a high-definition image display apparatus, approximately P=200 μm. Thus, $W+L\leqq 40$ μm is a necessary condition.

EXAMPLES

Example 1

An electron source of the configuration shown in FIG. 1 was constructed using the process shown in FIG. 2.

An electron source substrate 1 was created by forming a 400-nm silica coat on 2.8-mm thick glass (PD200 manufactured by Asahi Glass Co., Ltd.) by spattering, where the silica coat would serve as an alkali block layer to prevent impact on electron source characteristics.

A Ti film 5 nm in thickness was formed on the electron source substrate 1, a Pt thin-film 20 nm in thickness was formed by spattering, and device electrodes 2 and 3 were formed by patterning through photoresist application, exposure, developing and etching.

Then, photosensitive printing paste containing Ag was applied by screen printing. This was followed by drying, exposure, developing and baking to create signal wiring 4. Next, to obtain high positional accuracy, a photo paste was applied by screen printing, where the photo paste was largely composed of PbO which in turn consisted of glass content and a photosensitive material. This was followed by drying, exposure, developing and baking to create an insulating layer 5. As shown in FIG. 1, the signal wiring 4 was laid in such a way as to cover the insulating layer 5. The photo paste containing Ag was applied on top of it by screen printing, followed by drying and baking to create scan wiring 6.

After cleaning the substrate, a conductive film 7 consisting of PdO was created through application by an inkjet process and subsequent baking.

The distance L from a suddenly changing portion 13 to the insulating layer 5 was 15 μm, the covering width W of the device electrodes 2 and 3 in the insulating layer 5 was 20 μm, and the distance P from the suddenly changing portion 13 to the adjacent electron-emitting device (distance P from the suddenly changing portion 13 to the electron emitting area 8) was 175 μm.

Next, the electron source was obtained after forming and an activation process. Then, the electron source substrate was bonded by sealing to a face plate equipped with a light emitting member (not shown) and consequently an image display apparatus was constructed. Subsequently, it was electrically connected with a driver (not shown) and high-voltage power supply and an image was displayed by applying a predetermined voltage.

Figure 8A:
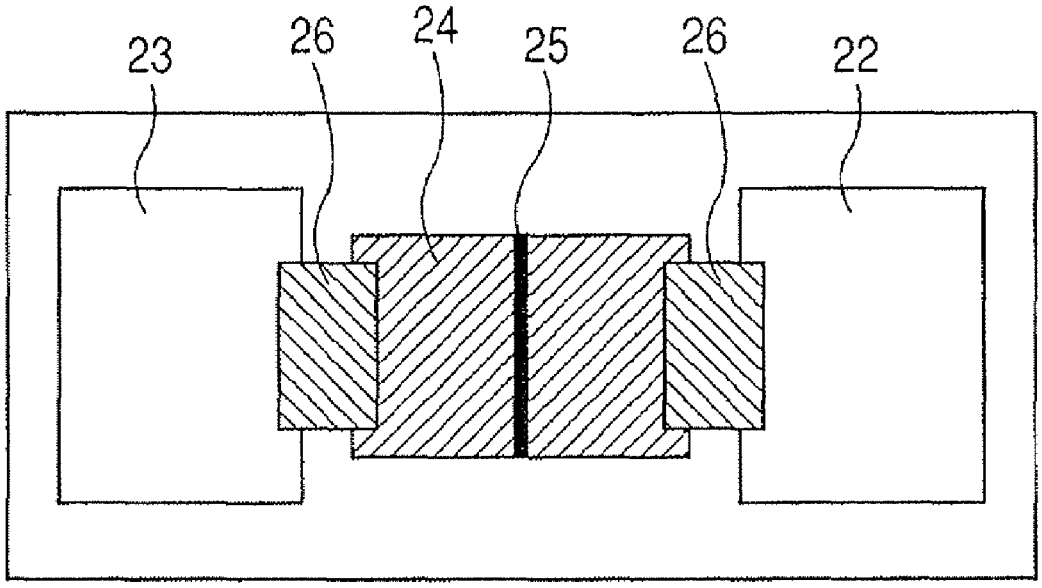
FIGS. 8A and 8B are schematic plan views of an electron source according to a conventional example.
Figure 8B:
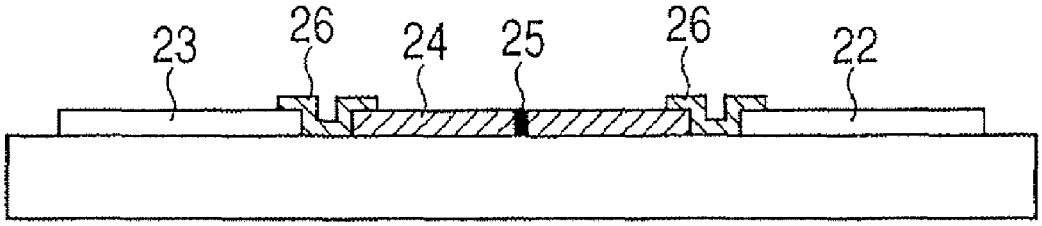

FIGS. 8A and 8B show configurations of the electron source disclosed in Japanese Patent Application Laid-Open No. H09-298030. In FIGS. 8A and 8B, reference numeral 21 denotes a substrate, 22 and 23 denote device electrodes, 24 denotes a conductive film (device film), 25 denotes an electron emitting area, and 26 denotes a overcurrent protective film (low melting-point material which functions as a fuse). This configuration differs from the above example in that it does not provide an arc extinction structure because only the fuse (low melting-point material) 26 is installed instead of covering hot portions partially with an insulating layer serving as shielding material. Specifically, a cathode spot moves to a fuse when discharging occurs, where the discharge is sustained, and this can cause the gas to fly to an adjacent device to which a voltage is applied, initiating a cycle of discharging and damage in the adjacent device as well. That is, since it is not possible to control locations of fuse blowouts, it may take time before a fuse blowout and a large volume of gas may be generated, causing new discharges in adjacent devices.

Even with the image display apparatus according to the present invention, discharges may occur when the voltage applied is increased. When discharge damage was closely observed, it was found that the rate at which the discharge damage was confined within a single device was far higher than that of the conventional example, thereby confirming the advantage of the present invention.

Also, as a comparative example, an image display apparatus was constructed and examined, where the distance L from the suddenly changing portion 13 in FIG. 1 to the insulating layer was set to 20 μm, the covering width W of the device electrodes with the insulating layer was set between 50 and 10 μm, and the distance P to the adjacent electron-emitting device to which a voltage is applied (distance P from the suddenly changing portion 13 to the electron emitting area 8) was set to 175 μm. As a result, it was found that the rate at which the discharge damage was confined within a single device according to the present invention was higher than any of the comparative examples.

Example 2

Figure 7:
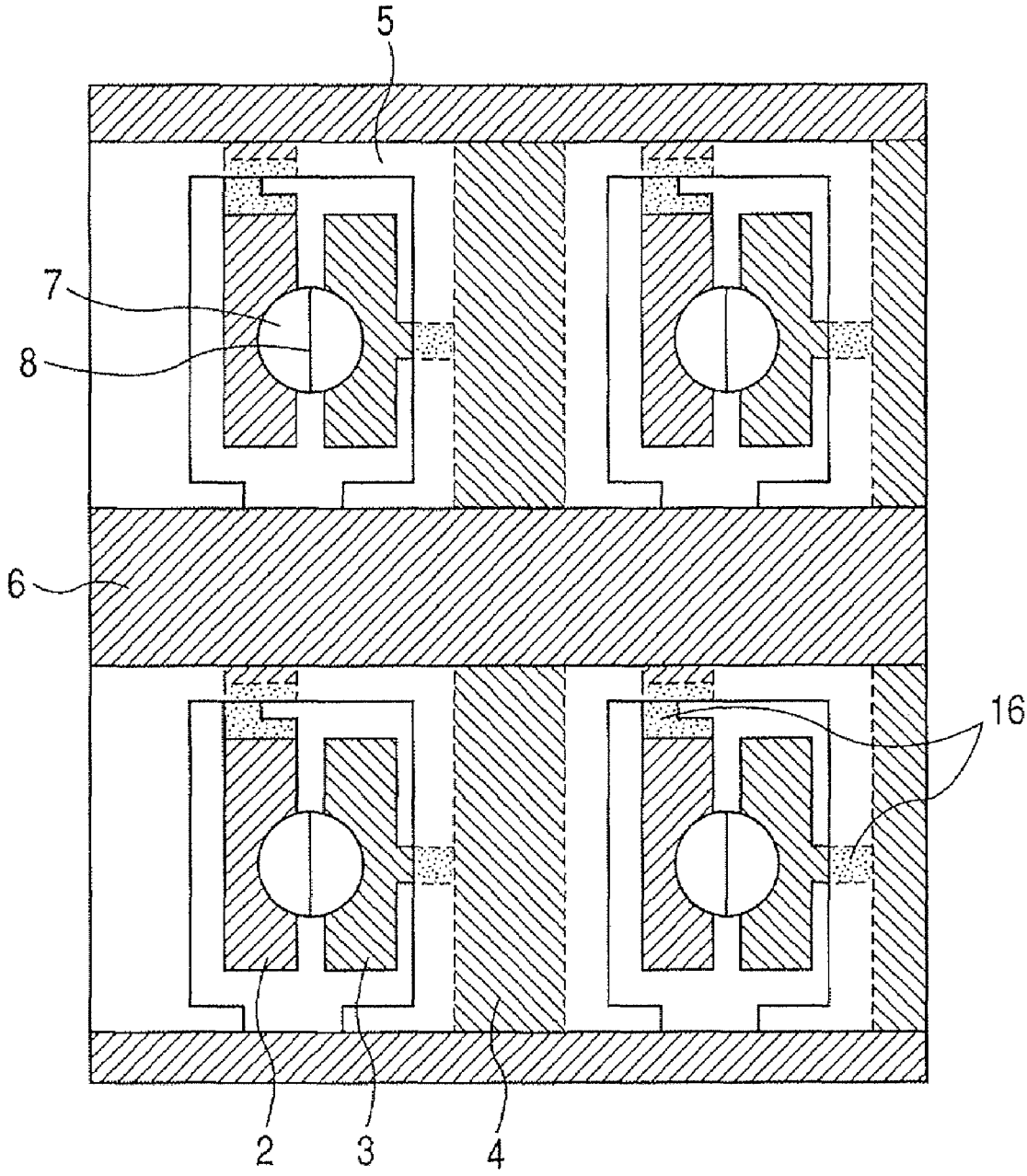
FIG. 7 is a schematic plan view of an electron source produced in a second example of the present invention.

An electron source of the configuration shown in FIG. 7 was constructed.

Example 2 differs from example 1 in that high-resistance portions 16 (suddenly changing portion of resistance) are provided, that the high-resistance portions 16 have smaller width, and that ITO is used as material. Thus, when cathode spots are initiated, the high-resistance portions 16 tend to be reduced into a material with a lower melting point than the insulating layer 5 which is a covering material. The use of low-resistance material for the high-resistance portions 16 makes it possible to maintain the insulating layer 5 which is a covering material in a stable condition and increase the stability of arc extinction.

An ITO layer was formed by spattering and then patterned. The rest of the fabrication method was the same as example 1.

In this example, the distance L from the suddenly changing portion 13 of the high-resistance portion 16 which would become hot to the insulating layer 5 was set to 10 μm, the covering width W of the device electrodes with the insulating layer was set to 20 μm, and the distance P to the adjacent electron-emitting device to which a voltage is applied (distance P from the suddenly changing portion 13 to the electron emitting area 8) was set to 160 μm.

Discharges were generated by increasing the voltages applied to the image display apparatus according to this example and image display apparatus equipped with the electron source according to the conventional example and discharge damage was observed closely. As a result, it was found that the rate at which the discharge damage was confined within a single device was much higher according to this example, thereby confirming the advantage of the present invention.

According to the present invention, hot portions (second areas) in the device electrodes melt and break during discharging, extinguishing the discharges and suppressing new discharges in adjacent electron-emitting devices efficiently. This minimizes the impact of discharging, making it possible to provide highly reliable image display apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-241944, filed Aug. 24, 2005 and No. 2006-215176, filed on Aug. 8, 2006 hereby incorporated by reference herein in their entirety.

What is claimed is:

1. An electron source comprising:

a plurality of electron-emitting devices each of which has a pair of device electrodes and an electron emitting area between the pair of device electrodes;

first wiring which connects one of the pair of device electrodes of the plurality of electron-emitting devices;

second wiring which connects the other of the pair of device electrodes of the plurality of electron-emitting devices and intersects the first wiring; and an insulating layer which insulates at least an intersection of the first wiring and second wiring and partially covers at least one of the pair of device electrodes, wherein the one of the pair of device electrodes has a first area and a second area located between the first area and the first wiring, and wherein the second area is more fusible than the first area, and the second area is partially exposed and covered with the insulating layer.

2. The electron source according to claim 1, wherein the following relationship is satisfied:

$$W+L \leqq (P/5)$$

where L is distance from an exposed area of the second area to the insulating layer, W is width of the exposed area at a boundary between the exposed area and the insulating layer, and P is distance from the exposed area to an adjacent electron-emitting device.

3. The electron source according to claim 1, wherein width of the second area is smaller than width of the first area.

4. The electron source according to claim 1, wherein thickness of the second area is smaller than thickness of the first area.

5. The electron source according to claim 1, wherein resistance of the second area is higher than resistance of the first area.

6. The electron source according to claim 5, wherein the second area is made of a higher-resistance material than the first area.

7. The electron source according to claim 1, wherein the second area is made of a material with a smaller heat diffusion coefficient than the first area.

8. An image display apparatus comprising:

the electron source according to claim 1; and an image forming member which has at least a light emitting member for emitting light by irradiation with electrons emitted from the electron source and electrodes used to apply voltage to accelerate the electrons.

* * * * *

UNITED STATES PATENT AND TRADEMARK OFFICE

CERTIFICATE OF CORRECTION

PATENT NO. : 7,382,088 B2
APPLICATION NO. : 11/464098
DATED : June 3, 2008
INVENTOR(S) : Hisanobu Azuma et al.

It is certified that error appears in the above-identified patent and that said Letters Patent is hereby corrected as shown below:

COLUMN 7:

Line 40, “gas partial” should read --partial gas--; and
Line 66, “$1H=(fx\mathrm{N})^{-1}$[sec].” should read --$1H=(fx\mathrm{N})^{-1}$[sec]--.

COLUMN 8:

Line 1, “Wherein,” should read --wherein,--.

COLUMN 10:

Line 56, “is distance” should read --is a distance--;
Line 57, “is width” should read --is a width--;
Line 59, “is distance” should read --is a distance--;
Line 62, “width” should read --a width-- and
“than width” should read --than a width--; and
Line 66, “thickness” should read --a thickness-- and
“than thickness” should read --than a thickness--.

COLUMN 11:

Line 2, “resistance” should read --a resistance-- and
“than resistance” should read --than a resistance--.

UNITED STATES PATENT AND TRADEMARK OFFICE

CERTIFICATE OF CORRECTION

PATENT NO. : 7,382,088 B2
APPLICATION NO. : 11/464098
DATED : June 3, 2008
INVENTOR(S) : Hisanobu Azuma et al.

It is certified that error appears in the above-identified patent and that said Letters Patent is hereby corrected as shown below:

COLUMN 12:

Line 2, "and an" should read --and ¶ an--.

Signed and Sealed this

Twenty-third Day of December, 2008

JON W. DUDAS
*Director of the United States Patent and Trademark Office*